US011426748B1

(12) United States Patent
Chu

(10) Patent No.: US 11,426,748 B1
(45) Date of Patent: Aug. 30, 2022

(54) REFILLABLE SPRAYER WITH EXPLOSION-PROOF EFFECT

(71) Applicant: Bo-Lang Chu, Taichung (TW)

(72) Inventor: Bo-Lang Chu, Taichung (TW)

( * ) Notice: Subject to any disclaimer, the term of this patent is extended or adjusted under 35 U.S.C. 154(b) by 0 days.

(21) Appl. No.: 17/316,827

(22) Filed: May 11, 2021

(51) Int. Cl.
*B65D 1/42* (2006.01)
*B05B 11/00* (2006.01)
*B05B 15/14* (2018.01)

(52) U.S. Cl.
CPC ..... *B05B 11/0056* (2013.01); *B05B 15/14* (2018.02)

(58) Field of Classification Search
CPC ..... B05B 11/0056; B05B 15/14
See application file for complete search history.

(56) References Cited

U.S. PATENT DOCUMENTS

| | | | | |
|---|---|---|---|---|
| 3,964,636 | A | 6/1976 | Rehrig | |
| 5,960,998 | A * | 10/1999 | Brown | B05B 11/0037 222/146.2 |
| 2003/0102335 | A1* | 6/2003 | Barnett | B05B 9/0838 222/386.5 |
| 2006/0286006 | A1* | 12/2006 | McDaniel | C02F 3/342 366/241 |
| 2010/0320286 | A1* | 12/2010 | Lang | B05B 9/0822 239/146 |
| 2019/0119032 | A1* | 4/2019 | Chu | B65D 83/38 |

FOREIGN PATENT DOCUMENTS

| | | | | |
|---|---|---|---|---|
| CN | 201249909 | Y * | 6/2009 | |
| CN | 202754349 | U * | 2/2013 | |
| CN | 103523416 | A * | 1/2014 | B65D 88/1687 |
| CN | 204026126 | U * | 12/2014 | |
| CN | 105151450 | A * | 12/2015 | |
| CN | 105151450 | A | 12/2015 | |
| CN | 204879445 | U * | 12/2015 | |
| CN | 206637247 | U * | 11/2017 | |
| TW | 172634 | | 11/1991 | |
| TW | I625485 | B | 6/2018 | |
| WO | WO2020088944 | A1 | 5/2020 | |

* cited by examiner

*Primary Examiner* — Paul R Durand
*Assistant Examiner* — Bob Zadeh
(74) *Attorney, Agent, or Firm* — Karin L. Williams; Alan D. Kamrath; Mayer & Williams PC

(57) ABSTRACT

A refillable sprayer with explosion-proof effect has a first shell, a second shell, and a retaining ring. The first shell has a first body and a first mesh body. The first body is made of plastic. The first mesh body is made of metal, is covered by the first body, and has multiple first through holes. The second shell is detachably connected to the first shell and has a second body and a second mesh body. The second body is made of plastic. The second mesh body is made of metal, is covered by the second body, and has multiple second through holes. The retaining ring is made of metal and is sleeved on a connecting position where the second shell is connected to the first shell.

20 Claims, 7 Drawing Sheets

REFILLABLE SPRAYER WITH EXPLOSION-PROOF EFFECT

BACKGROUND OF THE INVENTION

1. Field of the Invention

The present invention relates to a sprayer, and more particularly to a refillable sprayer that is made of different materials, can be reused, and is environmentally friendly, convenient, and safe with an explosion-proof effect.

2. Description of Related Art

A conventional refillable sprayer has a lower shell, an upper shell, and a retaining ring. Both the lower shell and the upper shell are made of plastic, and the upper shell is detachably connected to the lower shell. The retaining ring is made of metal and is mounted on a connection position between the upper shell and the lower shell. The upper shell is detachably connected to the lower shell, so when the liquid in the conventional refillable sprayer is used up, the upper shell can be disassembled from the lower shell and the liquid can be injected into the lower shell. Then, the upper shell is reinstalled on the lower shell, and a pressurized gas is finally filled into the conventional refillable sprayer, so that the conventional refillable sprayer can be reused without unnecessary waste and is environmentally friendly. The retaining ring is a reinforcing element for holding the upper shell and the lower shell to enable the conventional refillable sprayer formed by the upper shell and the lower shell to withstand the high pressure gas.

However, the retaining ring is only mounted on the connection position between the upper shell and the lower shell, and the lower shell and the upper shell are made of plastic. When the instantaneous gas pressure is too high, the lower shell or a position where the upper shell is not connected with the retaining ring may still be cracked due to insufficient structural strength. Therefore, the conventional refillable sprayer has to be improved.

To overcome these shortcomings, the present invention provides a refillable sprayer with an explosion-proof effect to mitigate or obviate the aforementioned problems.

SUMMARY OF THE INVENTION

The primary objective of the present invention is to provide a refillable sprayer that is made of different materials, can be reused, and is environmentally friendly, convenient, and safe with an explosion-proof effect.

The refillable sprayer with explosion-proof effect in accordance with the present invention has a first shell, a second shell, and a retaining ring. The first shell has a first body and a first mesh body. The first body is made of plastic. The first mesh body is made of metal, is covered by the first body, and has multiple first through holes. The second shell is detachably connected to the first shell and has a second body and a second mesh body. The second body is made of plastic. The second mesh body is made of metal, is covered by the second body, and has multiple second through holes. The retaining ring is made of metal and is sleeved on a connecting position where the second shell is connected to the first shell.

Other objects, advantages and novel features of the invention will become more apparent from the following detailed description when taken in conjunction with the accompanying drawings.

DETAILED DESCRIPTION OF PREFERRED EMBODIMENT

Figure 1:
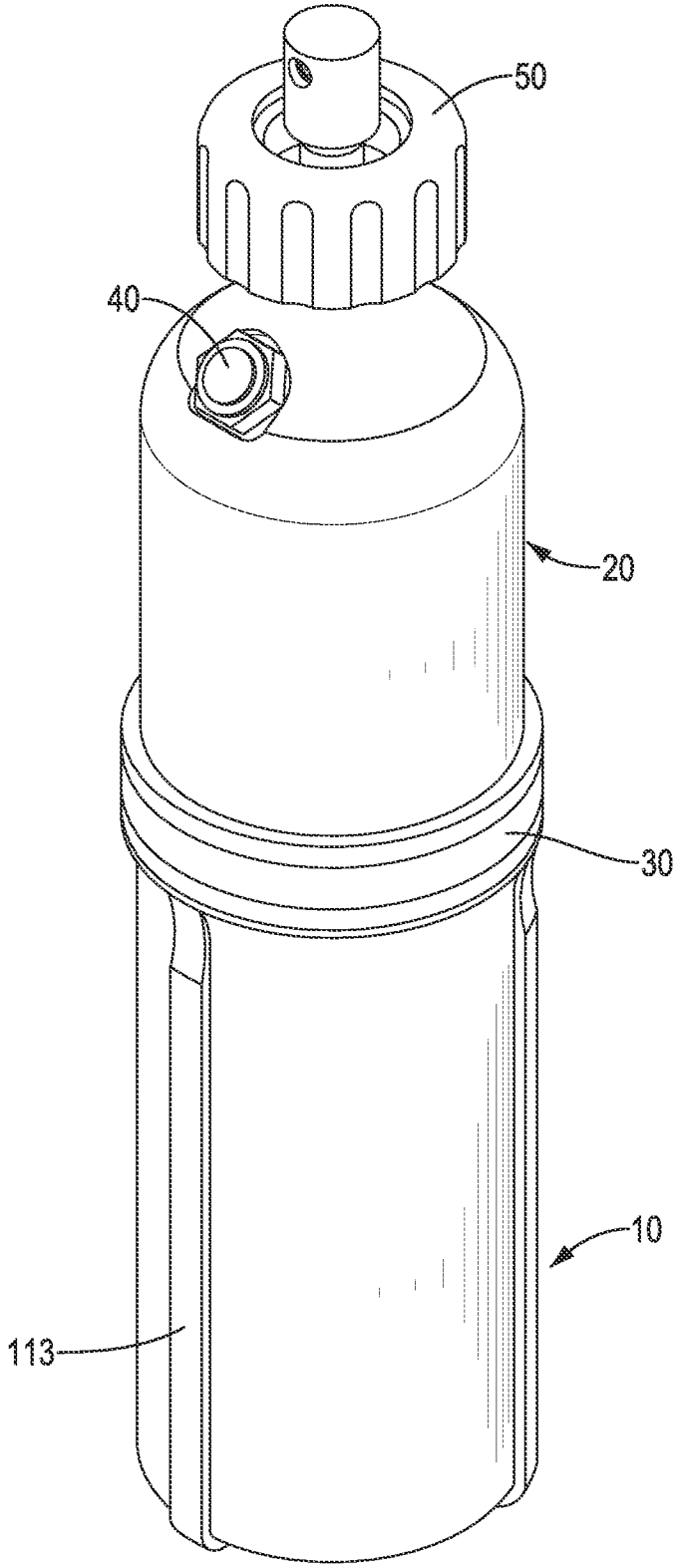
FIG. 1 is a perspective view of a refillable sprayer with explosion-proof effect in accordance with the present invention.
Figure 2:
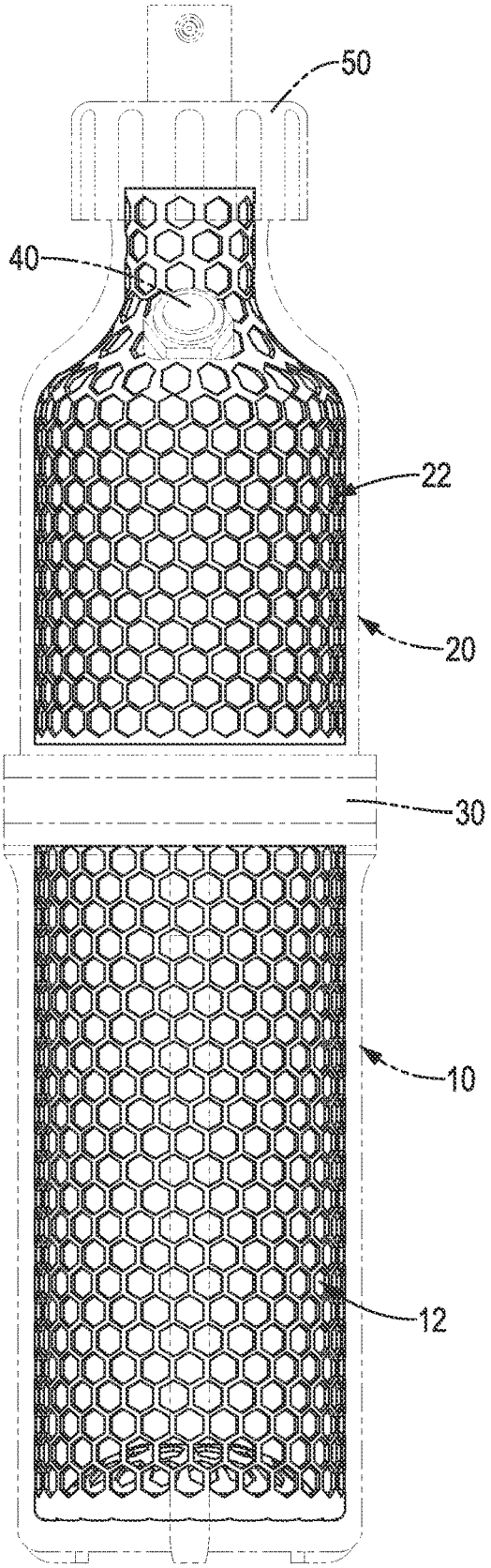
FIG. 2 is a front side perspective view of the refillable sprayer in FIG. 1.

With reference to FIGS. 1 to 4, a refillable sprayer with explosion-proof effect in accordance with the present invention comprises a first shell 10, a second shell 20, a retaining ring 30, a pressure relief valve 40, and a nozzle assembly 50.

Figure 3:
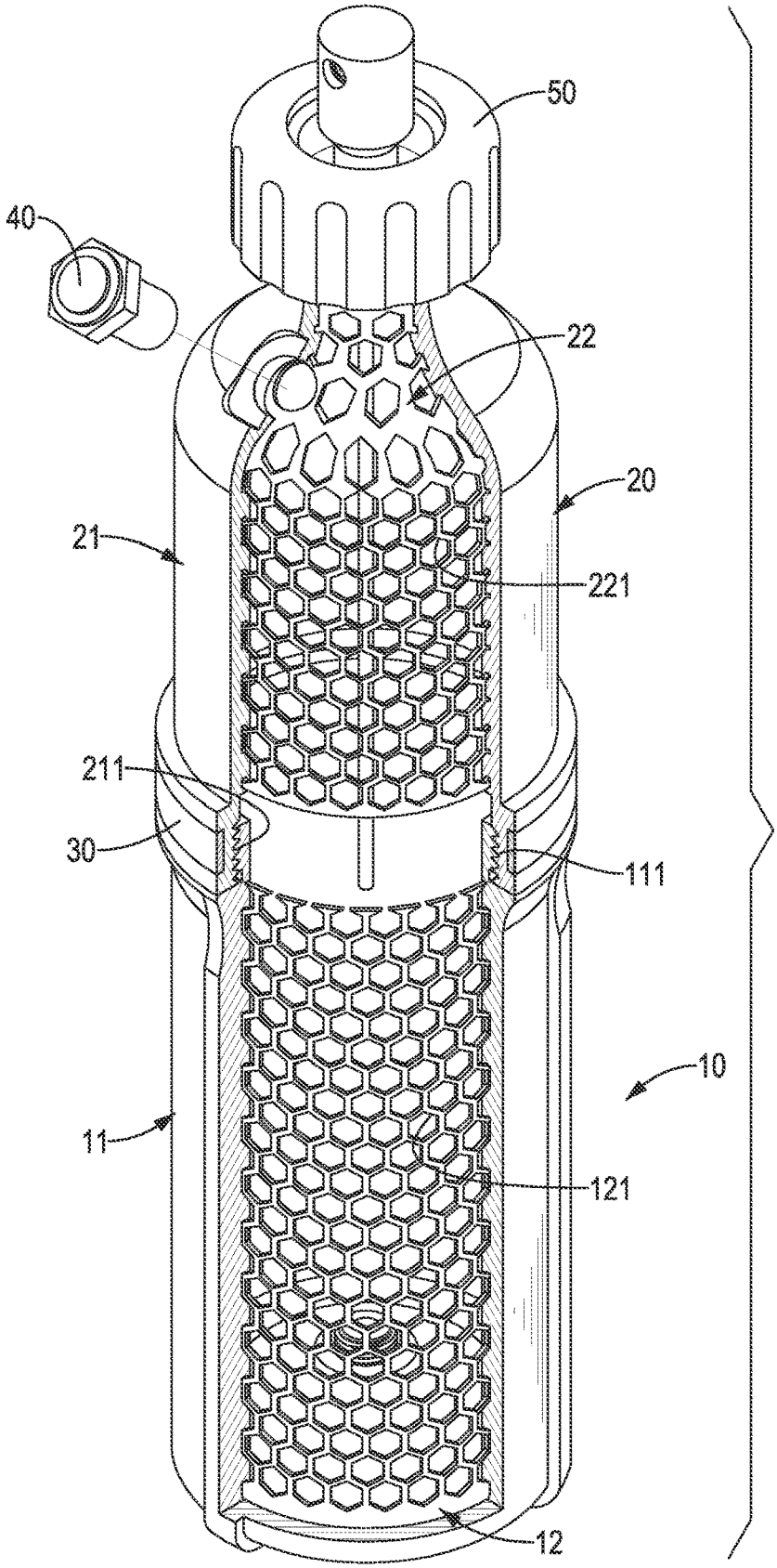
FIG. 3 is an exploded perspective view in partial section of the refillable sprayer in FIG. 1.
Figure 4:
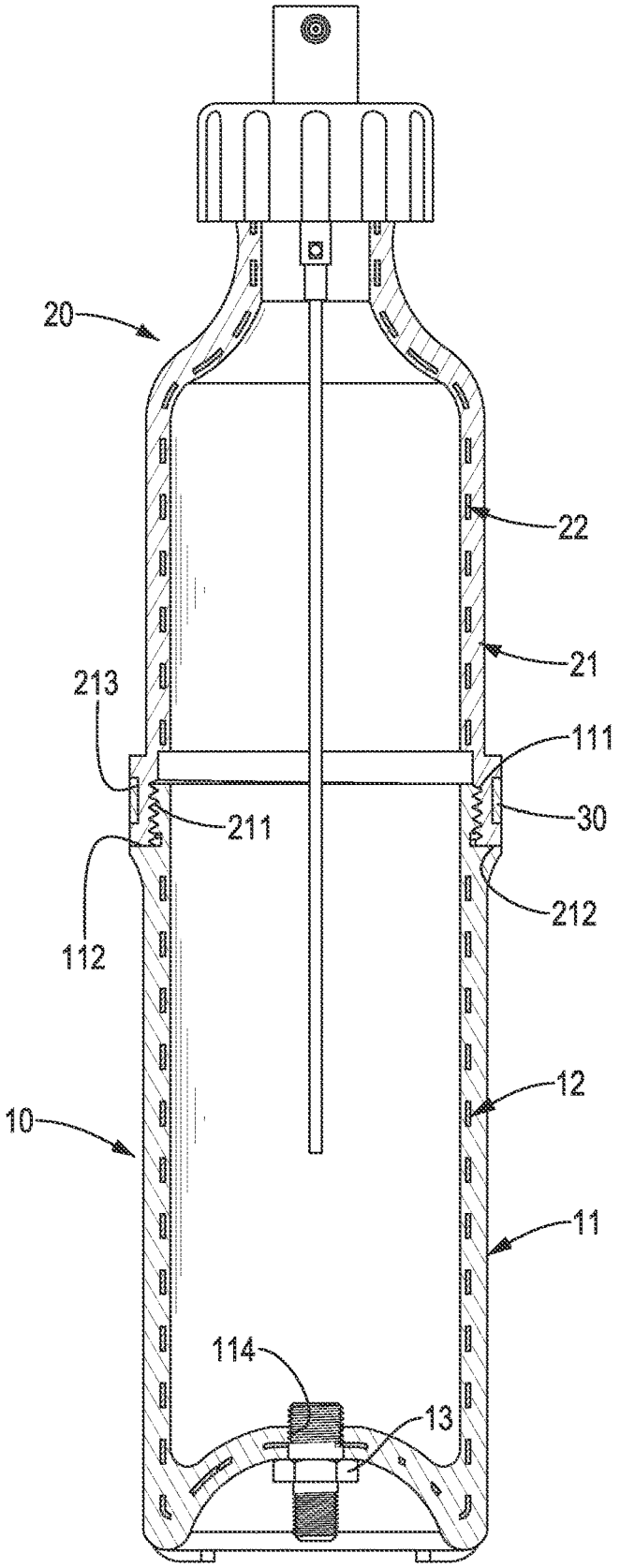
FIG. 4 is a front side view in partial section of the refillable sprayer in FIG. 1.

With reference to FIGS. 3 to 6, the first shell 10 is disposed on a lower half of the refillable spryer and has a first body 11, a first mesh body 12, and an injection valve 13. The first body 11 is made of plastic and has a first threaded portion 111, a first abutting face 112, multiple ribs 113, and an injecting hole 114. The first threaded portion 111 is formed on an upper end of the first body 11 adjacent to the second shell 20. The first abutting face 112 is formed on the first body 11 adjacent to the first threaded portion 111 opposite to the second shell 20. The multiple ribs 113 are formed on an external surface of the first body 11 at spaced intervals. With reference to FIG. 4, the injecting hole 114 is formed through a lower end of the first body 11.

The first mesh body 12 is made of metal, is covered by the first body 11 and has multiple first through holes 121 formed through the first mesh body 12 at spaced intervals. Furthermore, each one of the multiple first through holes 121 is a round hole, a polygonal hole, or a hole in any other shape. In the present invention, each first through hole 121 is hexagonal and a solid part around the first through hole 121 receives equal force in all directions, and the above-mentioned structure is easy to disperse force, so that the first mesh body 12 has a high compressive capacity, thereby improving the overall compressive capacity of the first shell 10. The injection valve 13 is connected to the injecting hole 114 of the first body 11.

In the present invention, the first body 11 is combined with the first mesh body 12 by injection molding. When the plastic material of the first body 11 is injection-molded, the liquid plastic material is projected to an inner side and an outer side of the first mesh body 12 to form plastic material layers located inside and outside the first mesh body 12 respectively, extends through each one of the multiple first through holes 121 of the first mesh body 12, is closely integrated with the first mesh body 12, and covers the multiple first through holes 121.

With reference to FIGS. 3 to 5 and 7, the second shell 20 is disposed on an upper half of the refillable spryer, is detachably connected to the first shell 10, and has a second body 21 and a second mesh body 22. The second body 21 is made of plastic and has a second threaded portion 211, a second abutting face 212, a mounting recess 213, and an outlet portion 214. The second threaded portion 211 is formed on a lower end of the second body 21 adjacent to the first body 11 of the first shell 10. The second shell 20 is connected to the first shell 10 by the second threaded portion 211 of the second body 21 screwed with the first threaded portion 111 of the first body 11. The second abutting face 212 is formed at the lower end of the second body 21 adjacent to the first body 11 of the first shell 10. When the second threaded portion 211 is screwed with the first threaded portion 111, the second abutting face 212 abuts against the first abutting face 112. The mounting recess 213 is annularly formed on an external surface of the second body 21 around the second threaded portion 211. The outlet portion 214 is formed on an upper end of the second body 21 away from the first shell 10.

Figure 7:
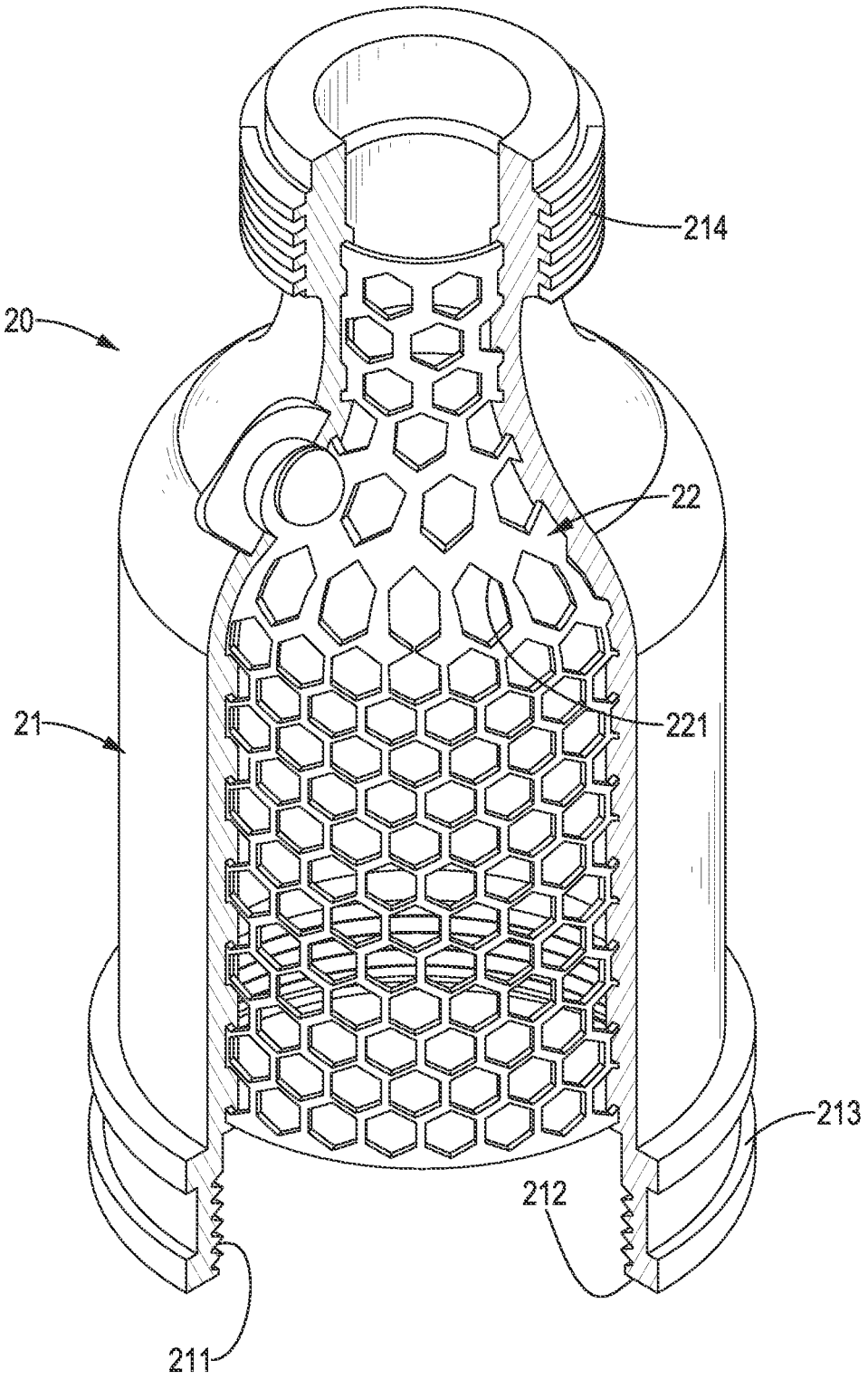
FIG. 7 is an enlarged perspective view in partial section of a second shell of the refillable spryer in FIG. 1.

With reference to FIGS. 3, 4, and 7, the second mesh body 22 is made of metal, is covered by the second body 21 and has multiple second through holes 221 formed through the second mesh body 22 at spaced intervals. Furthermore, each one of the multiple second through holes 221 is a round hole, a polygonal hole, or a hole in any other shape. In the present invention, each second through hole 221 is hexagonal and a solid part around the second through hole 221 receives equal force in all directions, and the above-mentioned structure is easy to disperse force, so that the second mesh body 22 has a high compressive capacity, thereby improving the overall compressive capacity of the second shell 20.

In the present invention, the second body 21 is combined with the second mesh body 22 by injection molding. When the plastic material of the second body 21 is injection-molded, the liquid plastic material is projected to an inner side and an outer side of the second mesh body 22 to form plastic material layers located inside and outside the second mesh body 22 respectively, extends through each one of the multiple second through holes 221 of the second mesh body 22, is closely integrated with the second mesh body 22, and covers the multiple second through holes 221.

With reference to FIGS. 3, 4, and 7, the retaining ring 30 is made of metal and is mounted in the mounting recess 213 of the second body 21 of the second shell 20. Since the mounting recess 213 is annularly disposed around the second threaded portion 211 and the second shell 20 is connected to the first shell 10 by the second threaded portion 211 and the first threaded portion 111, the retaining ring 30 is sleeved on a connecting position where the second shell 20 is connected to the first shell 10. Since the retaining ring 30 is made of metal and has high strength, the retaining ring 30 is sleeved at the connecting position between the second shell 20 and the first shell 10 to avoid a tank formed by the second shell 20 and the first shell 10 from separating due to inability to withstand excessively high pressure gas.

Figure 5:
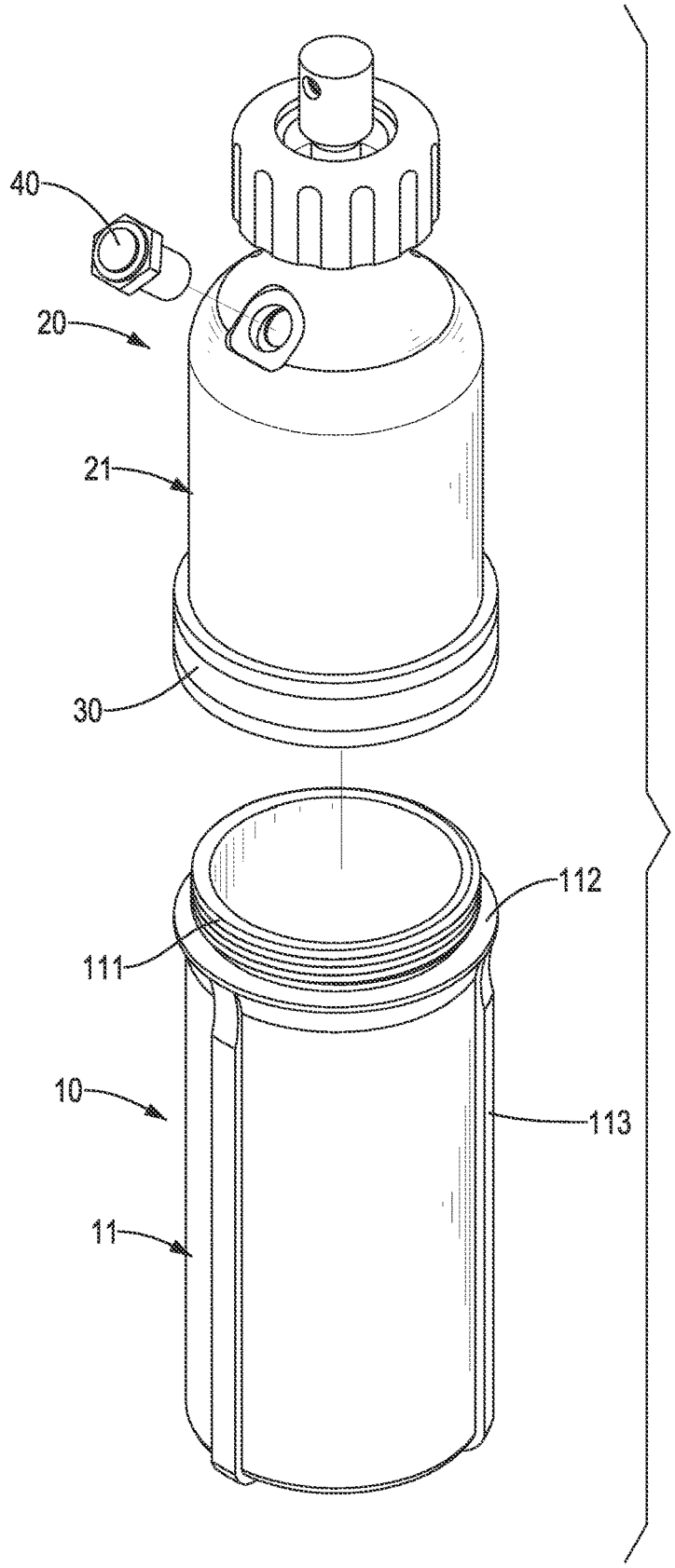
FIG. 5 is an exploded perspective view of the refillable spryer in FIG. 1.
Figure 6:
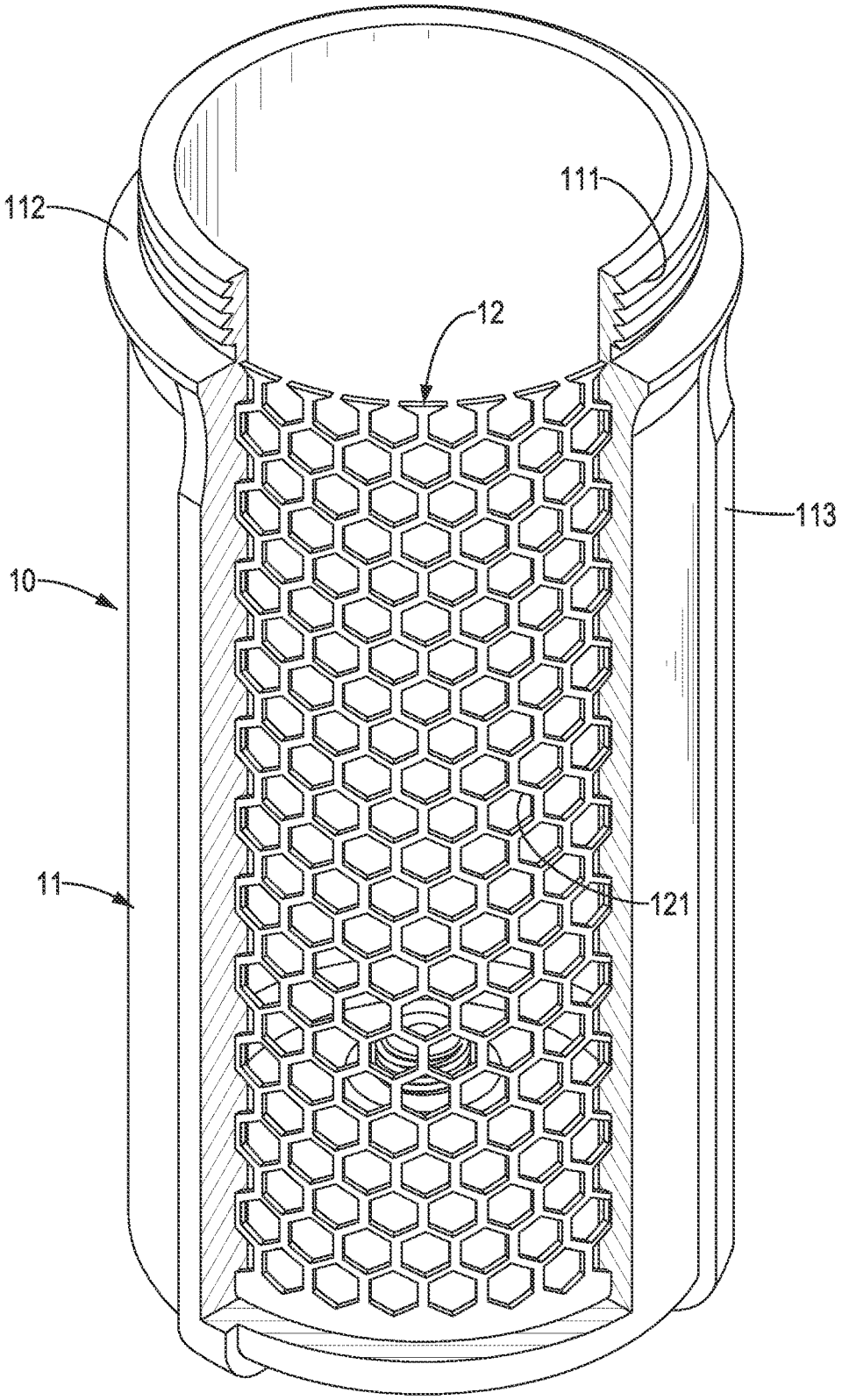
FIG. 6 is an enlarged perspective view in partial section of a first shell of the refillable spryer in FIG. 1.

With reference to FIGS. 3 and 5, the pressure relief valve 40 is connected to the second shell 20 and extends through the second body 21 and the second mesh body 22 of the second shell 20. When the internal pressure of the tank formed by the second shell 20 and the first shell 10 is too high, the pressure can be released through the pressure relief valve 40.

With reference to FIGS. 3 and 7, the nozzle assembly 50 is connected to the outlet portion 214 of the second body 21 of the second shell 20. The nozzle assembly 50 is conventional and the features and the structures of the nozzle assembly 50 are not described in detail.

With reference to FIGS. 3 and 5, when the liquid contained in the refillable sprayer with explosion-proof effect is used up, a user can rotate the second shell 20 to separate the second shell 20 from the first shell 10, and liquid is injected into the first shell 10, and then the second shell 20 is reassembled with the first shell 10, and finally high-pressure gas is injected into the tank formed by the first shell 10 and the second shell 20 via the injection valve 13 of the first shell 10. The refillable sprayer with explosion-proof effect of the present invention can be reused, is environmentally friendly, and is convenient to use. When the user wants to use the refillable sprayer with explosion-proof effect of the present invention, the user presses the nozzle assembly 50, and the liquid contained in the present invention is sprayed out in the form of spray.

According to the above-mentioned features and structural relationships of the refillable spryer with explosion-proof effect of the present invention, the present invention has the following advantages.

First, compared with the conventional refillable sprayer, the retaining ring is only sleeved at the connection position of the upper shell and the lower shell, and the lower shell and the upper shell are both made of plastic. When the instantaneous gas pressure is too high, the position where the lower shell or the upper shell is not in contact with the retaining ring may be cracked due to insufficient structural strength. The refillable sprayer with explosion-proof effect of the present invention is provided with the first mesh body 12 and the second mesh body 22 in the first shell 10 and the second shell 20 respectively, and the first mesh body 12 and the second mesh body 22 are both made of metal. Therefore, it can reinforce the structural strength of the connecting position where the first shell 10 and the second shell 20 are not in contact with the retaining ring 30, so as to prevent the momentary gas pressure from being too high and causing the rupture of the first shell 10 and the second shell 20, thereby ensuring safety during use.

Second, each one of the first through holes 121 of the first mesh body 12 of the first shell 10 and each one of the second through holes 221 of the second mesh body 22 of the second shell 20 are hexagonal, so the first mesh body 12 and the second mesh body 22 have high compressive resistance.

Third, the retaining ring 30 is sleeved on the mounting recess 213 of the second body 21 of the second shell 20. When gas escapes from a gap between the second shell 20 and the first shell 10, since the retaining ring 30 is limited in the mounting recess 213 and cannot be displaced relative to the second shell 20, the retaining ring 30 is always sleeved on the second shell 20 and connected to the first shell 10, and this may further strengthen the stability of the combination between the second shell 20 and the first shell 10.

Fourth, compared with a conventional one-piece sprayer made of metal, it is non-permeable and it is impossible to see the amount of liquid contained therein, and the weight is heavier. The first body 11 of the first shell 10 and the second body 21 of the second shell 20 of the refillable sprayer with explosion-proof effect of the present invention are both made of plastic, and are light-permeable, allowing the user to see remaining liquid in the refillable sprayer of the present invention from the outside. The residual amount of liquid contained in the refillable sprayer is lighter in weight, which solves the inconvenience of the use of the conventional one-piece sprayer made of metal.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A refillable sprayer with explosion-proof effect comprising:

a first shell having a first body made of plastic; and a first mesh body made of metal, covered by the first body and having multiple first through holes formed through the first mesh body at spaced intervals;

a second shell detachably connected to the first shell and having a second body made of the plastic; and a second mesh body made of the metal, covered by the second body and having multiple second through holes formed through the second mesh body at spaced intervals; and a retaining ring made of the metal and sleeved on a connecting position where the second shell is connected to the first shell, wherein the plastic of the first body is injection-molded, wherein liquid plastic is projected to an inner side and an outer side of the first mesh body to form multiple plastic layers located inside and outside the first mesh body respectively, extends through each one of the multiple first through holes of the first mesh body, is closely integrated with the first mesh body, and covers the multiple first through holes, and wherein the plastic of the second body is injection-molded, wherein liquid plastic is projected to an inner side and an outer side of the second mesh body to form multiple plastic layers located inside and outside the second mesh body respectively, extends through each one of the multiple second through holes of the second mesh body, is closely integrated with the second mesh body, and covers the multiple second through holes.

2. The refillable sprayer as claimed in claim 1, wherein each one of the first through holes is polygonal.

3. The refillable sprayer as claimed in claim 2, wherein the first body of the first shell has a first threaded portion formed on an end of the first body adjacent to the second body of the second shell;

the second body of the second shell has a second threaded portion formed on an end of the second body adjacent to the first body of the first shell; and the second shell is connected to the first shell by the second threaded portion of the second body connected to the first threaded portion of the first body of the first shell.

4. The refillable sprayer as claimed in claim 3, wherein the first body of the first shell has a first abutting face formed on the first body adjacent to the first threaded portion opposite to the second shell;

the second body of the second shell has a second abutting face formed on the second body adjacent to the first body of the first shell; and the second abutting face abuts against the first abutting face.

5. The refillable sprayer as claimed in claim 2, wherein the refillable sprayer has a pressure relief valve connected to the second shell and extending through the second body and the second mesh body of the second shell.

6. The refillable sprayer as claimed in claim 1, wherein each one of the second through holes is polygonal.

7. The refillable sprayer as claimed in claim 2, wherein each one of the first through holes is hexagonal.

8. The refillable sprayer as claimed in claim 7, wherein the first body of the first shell has a first threaded portion formed on an end of the first body adjacent to the second body of the second shell;

the second body of the second shell has a second threaded portion formed on an end of the second body adjacent to the first body of the first shell; and the second shell is connected to the first shell by the second threaded portion of the second body connected to the first threaded portion of the first body of the first shell.

9. The refillable sprayer as claimed in claim 8, wherein the first body of the first shell has a first abutting face formed on the first body adjacent to the first threaded portion opposite to the second shell;

the second body of the second shell has a second abutting face formed on the second body adjacent to the first body of the first shell; and the second abutting face abuts against the first abutting face.

10. The refillable sprayer as claimed in claim 6, wherein each one of the second through holes is hexagonal.

11. The refillable sprayer as claimed in claim 10, wherein the first body of the first shell has a first threaded portion formed on an end of the first body adjacent to the second body of the second shell;

the second body of the second shell has a second threaded portion formed on an end of the second body adjacent to the first body of the first shell; and the second shell is connected to the first shell by the second threaded portion of the second body connected to the first threaded portion of the first body of the first shell.

12. The refillable sprayer as claimed in claim 11, wherein the first body of the first shell has a first abutting face formed on the first body adjacent to the first threaded portion opposite to the second shell;

the second body of the second shell has a second abutting face formed on the second body adjacent to the first body of the first shell; and the second abutting face abuts against the first abutting face.

13. The refillable sprayer as claimed in claim 6, wherein the first body of the first shell has a first threaded portion formed on an end of the first body adjacent to the second body of the second shell;

the second body of the second shell has a second threaded portion formed on an end of the second body adjacent to the first body of the first shell; and the second shell is connected to the first shell by the second threaded portion of the second body connected to the first threaded portion of the first body of the first shell.

14. The refillable sprayer as claimed in claim 13, wherein the first body of the first shell has a first abutting face formed on the first body adjacent to the first threaded portion opposite to the second shell;

the second body of the second shell has a second abutting face formed on the second body adjacent to the first body of the first shell; and the second abutting face abuts against the first abutting face.

15. The refillable sprayer as claimed in claim 6, wherein the refillable sprayer has a pressure relief valve connected to the second shell and extending through the second body and the second mesh body of the second shell.

16. The refillable sprayer as claimed in claim 1, wherein the first body of the first shell has a first threaded portion formed on an end of the first body adjacent to the second body of the second shell, the second body of the second shell has a second threaded portion formed on an end of the second body adjacent to the first body of the first shell, and the second shell is connected to the first shell by the second threaded portion of the second body connected to the first threaded portion of the first body of the first shell.

17. The refillable sprayer as claimed in claim 16, wherein the first body of the first shell has a first abutting face formed on the first body adjacent to the first threaded portion opposite to the second shell;

the second body of the second shell has a second abutting face formed on the second body adjacent to the first body of the first shell; and the second abutting face abuts against the first abutting face.

18. The refillable sprayer as claimed in claim 17, wherein the second body of the second shell has a mounting recess formed on an external surface of the second body; and the retaining ring is mounted in the mounting recess.

19. The refillable sprayer as claimed in claim 1, wherein the second body of the second shell has a mounting recess formed on an external surface of the second body; and the retaining ring is mounted in the mounting recess.

20. The refillable sprayer as claimed in claim 1, wherein the refillable sprayer has a pressure relief valve connected to the second shell and extending through the second body and the second mesh body of the second shell.

* * * * *